US008986060B2

(12) United States Patent
Van Gompel

(10) Patent No.: US 8,986,060 B2
(45) Date of Patent: Mar. 24, 2015

(54) VEHICLE PROPULSION

(71) Applicant: James Van Gompel, Angola, IN (US)

(72) Inventor: James Van Gompel, Angola, IN (US)

(73) Assignee: Meg McCall, San Luis Obispo, CA (US)

( * ) Notice: Subject to any disclaimer, the term of this patent is extended or adjusted under 35 U.S.C. 154(b) by 0 days.

(21) Appl. No.: 13/839,452

(22) Filed: Mar. 15, 2013

(65) Prior Publication Data

US 2014/0271194 A1 Sep. 18, 2014

(51) Int. Cl.
*B63H 16/06* (2006.01)
*B63H 16/04* (2006.01)

(52) U.S. Cl.
CPC ..... *B63H 16/04* (2013.01)
USPC ..... 440/104

(58) Field of Classification Search
CPC ..... B63H 16/04; B63H 16/06
USPC ..... 440/102, 104
See application file for complete search history.

(56) References Cited

U.S. PATENT DOCUMENTS 468,960 A * 2/1892 Vondersaare ..... 440/109
2,083,004 A * 6/1937 Clark ..... 440/104
3,677,216 A * 7/1972 Gentemann ..... 440/102
4,679,516 A * 7/1987 Friesen ..... 114/91
4,820,216 A 4/1989 Masters
5,127,859 A * 7/1992 Rantilla ..... 440/104
5,851,132 A 12/1998 Merrill
6,022,255 A 2/2000 Lukanovich
6,101,678 A * 8/2000 Malloy et al. ..... 16/438
6,261,141 B1 7/2001 Heap
6,544,087 B1 4/2003 Peng
6,632,111 B2 * 10/2003 Oathout ..... 440/104
6,796,863 B1 * 9/2004 Oathout ..... 440/104
7,581,996 B1 * 9/2009 Boller ..... 440/104
2003/0040234 A1 2/2003 Oathout
2012/0028519 A1 2/2012 Rechner et al.

OTHER PUBLICATIONS

Oberlin; Angola man introduces Angle-Oar; News-Sun, Evening Star, Herald-Republican; TheOutdoorPage.com; Mar. 13, 2009; 1 page; KPC News; Kendalville, IN.

* cited by examiner

*Primary Examiner* — Edwin Swinehart
(74) *Attorney, Agent, or Firm* — Fitch, Even, Tabin & Flannery LLP

(57) ABSTRACT

A vehicle propulsion system having a mount; a rotation shaft oriented substantially normal to a plane of travel of a vehicle; a fixture coupled to the rotation shaft, the fixture being rotatable about a rotation shaft axis of the rotation shaft; and an oar assembly coupled to the fixture; wherein the coupling is coupled to the fixture, wherein the rotation shaft axis is substantially normal to the rotational axis; wherein the coupling is coupled to the fixture to permit rotation of the oar assembly about the rotation axis when the lock is locked.

17 Claims, 17 Drawing Sheets

VEHICLE PROPULSION

BACKGROUND OF THE INVENTION

1. Field of the Invention

The present invention relates generally to vehicle propulsion, and more specifically to human-powered vehicle propulsion, such as human-powered propulsion of a water vehicle.

2. Discussion of the Related Art

Kayakers and other boaters exhibit a wide range of skill levels, from the recreational kayaker to the professional competitor. Kayaking enthusiasts pursue their sport in a variety of settings, including creeks, rivers, and the ocean. Each of the settings presents unique challenges to the kayaker.

In order to kayak effectively, it is essential that the kayaker be able to effectively control the kayak with a minimum of effort; this is no less true for the recreational kayaker than it is for the expert. The essential element in kayak control is the kayak paddle. A kayak paddle that the user can easily and efficiently employ will greatly facilitate control of the kayak.

Kayak paddles include a single elongated shaft and two flattened blade portions, which may be either integral with the shaft or coupled thereto. The paddle is usually made of some suitably rigid material such as carbon fiber, wood, aluminum, or plastic. Low weight and sufficient strength to resist the forces imposed upon the paddle are important considerations in the manufacture of paddles.

To use a kayak paddle one grips and supports the shaft with both hands, generally perpendicular to the longitudinal axis of the kayak. A blade is inserted in the water near the side of the boat at a point in front of the user. The blade is then pulled backward approximately parallel to the longitudinal axis of the kayak, by backward pressure exerted through the hand closest to the blade in the water, while forward pressure is exerted through the other hand. When the blade has been pulled back to a point beside or just behind the user, it is removed from the water with an upward motion and the opposite blade is inserted in the water in front of the user. The sequence of motions is repeated, creating forces that propel the boat forward through the water. Subtle differences in the amount of force applied and the direction in which it is applied with each stroke are used to steer the kayak and keep it on course.

In order to paddle effectively, the kayaker must be able to hold the paddle continuously aloft with both hands while simultaneously twisting, rotating and raising/lowering the blades. This requires some amount of physical strength and coordination.

SUMMARY OF THE INVENTION

Several embodiments of the invention advantageously address the needs above as well as other needs by providing a vehicle propulsion system and method.

In one embodiment, the invention can be characterized as a vehicle propulsion system including a mount for mechanically coupling to a vehicle; a rotation shaft oriented substantially normal to a plane of travel of the vehicle; a fixture coupled to the rotation shaft, the fixture being rotatable about a rotation shaft axis of the rotation shaft; and an oar assembly coupled to the fixture, the oar assembly including a first blade, a first shaft, the first blade being coupled to a distal end of the first shaft, a second blade, a second shaft, the second blade being coupled to a distal end of the second shaft, a coupling interposed between a proximal end of the first shaft and a proximal end of the second shaft and selectively permitting rotation of the first shaft relative to the second shaft about a rotational axis, wherein the coupling includes a lock for locking the first shaft relative to the second shaft so as to prevent rotation of the first shaft relative to the second shaft when the lock is locked, a first adjuster, wherein the first adjuster adjusts the length of the first shaft, and a second adjuster, wherein the second adjuster adjusts the length of the second shaft; wherein the coupling is coupled to the fixture, wherein the rotation shaft axis is substantially normal to the rotational axis; wherein the coupling is coupled to the fixture to permit rotation of the oar assembly about the rotation axis when the lock is unlocked.

In another embodiment, the invention can be characterized as a method including mechanically coupling of a mount to a vehicle; orienting a rotation shaft substantially normal to a plane of travel of the vehicle; coupling a fixture to the rotation shaft, the fixture being rotatable about a rotation shaft axis of the rotation shaft; coupling an oar assembly to the fixture, the oar assembly including a first blade, a first shaft, the first blade being coupled to a distal end of the first shaft, a second blade, a second shaft, the second blade being coupled to a distal end of the second shaft, a coupling interposed between a proximal end of the first shaft and a proximal end of the second shaft and selectively permitting rotation of the first shaft relative to the second shaft about a rotational axis, wherein the coupling includes a lock for locking the first shaft relative to the second shaft so as to prevent rotation of the first shaft relative to the second shaft when the lock is locked, a first adjuster, wherein the first adjuster adjusts the length of the first rotation shaft, and a second adjuster, wherein the second adjuster adjusts the length of the second shaft; and coupling the coupling to the fixture to permit rotation of the oar assembly about the rotation axis when the lock is locked, wherein the rotation shaft axis is substantially normal to the rotational axis.

BRIEF DESCRIPTION OF THE DRAWINGS

The above and other aspects, features and advantages of several embodiments of the present invention will be more apparent from the following more particular description thereof, presented in conjunction with the following drawings.

Figure 1:
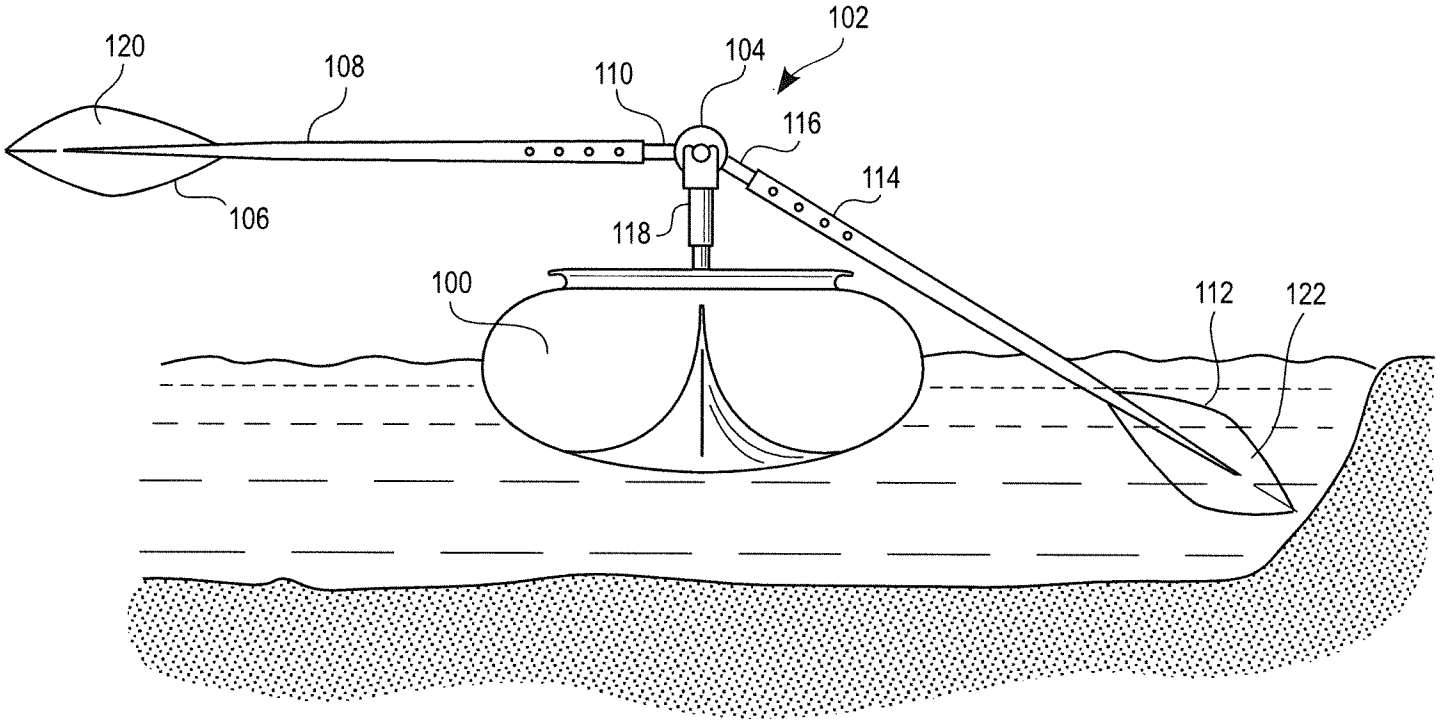
FIG. 1 is a simplified rear view of a kayak with an angle oar.

Corresponding reference characters indicate corresponding components throughout the several views of the drawings. Skilled artisans will appreciate that elements in the figures are illustrated for simplicity and clarity and have not necessarily been drawn to scale. For example, the dimensions of some of the elements in the figures may be exaggerated relative to other elements to help to improve understanding of various embodiments of the present invention. Also, common but well-understood elements that are useful or necessary in a commercially feasible embodiment are often not depicted in order to facilitate a less obstructed view of these various embodiments of the present invention.

DETAILED DESCRIPTION

The following description is not to be taken in a limiting sense, but is made merely for the purpose of describing the general principles of exemplary embodiments. The scope of the invention should be determined with reference to the claims.

The present invention in accordance with some embodiments provides a kayak paddle with a central support that is not found in present day kayaks. Some embodiments further provide for each paddle to be independently adjustable in length. Additional embodiments further provide for each paddle side to be rotatable to, for example, 4 angles relative to the paddle axis, allowing for the paddle to be adjusted for differing paddling conditions or to be operated with one hand. Some embodiments further provide for paddle blades shaped to allow for paddling in shallow water. In some variations, embodiments further provide for a paddle support mounting system coupled to the kayak floor. This bottom-mounted (or floor-mounted) support system is angled towards the kayak bow along a longitudinal axis of the kayak and provides for adjustment of the central support vertically and relative to the kayak. Some embodiments further provide for a paddle support system mounted to the underside of the foredeck of the kayak. This top-mounted support system is angled towards the kayak bow along a longitudinal axis of the kayak and provides for adjustment of the central support vertically and longitudinally relative to the kayak. The support system angle automatically angles the kayak paddle blades to provide some bite, advantageously keeping the blade in the water through the stroke. The present embodiments further provide for vertical rods that provide anchorage, kayak stabilization and assistance in entering and exiting any kayak or means of conveyance.

Furthermore, the described features, structures, or characteristics of the invention may be combined in any suitable manner in one or more embodiments. In the following description, numerous specific details are provided, to provide a thorough understanding of embodiments of the invention. One skilled in the relevant art will recognize, however, that the invention can be practiced without one or more of the specific details, or with other methods, components, materials, and so forth. In other instances, well-known structures, materials, or operations are not shown or described in detail to avoid obscuring aspects of the invention.

Figure 11:
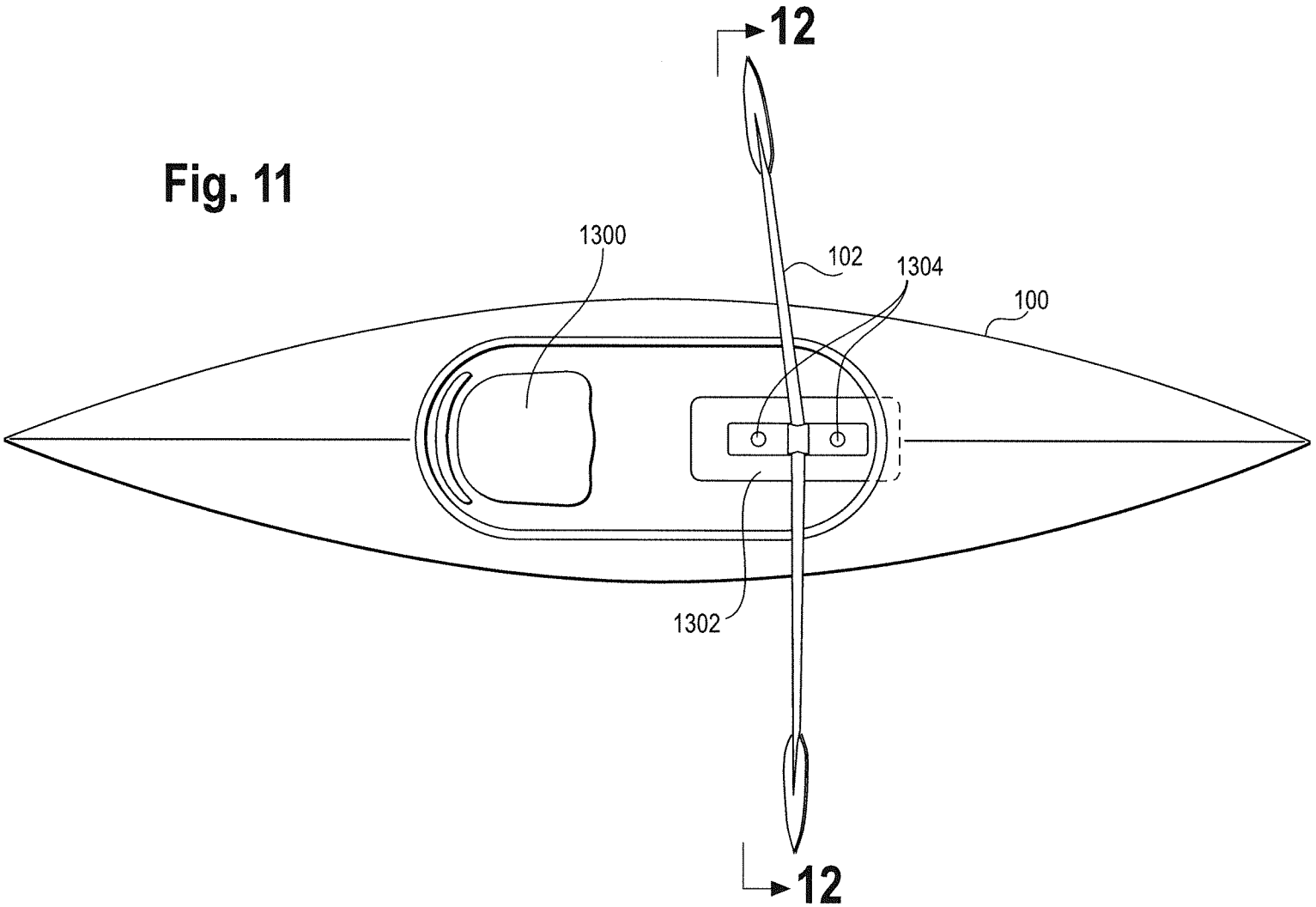
FIG. 11 is a top view of the kayak with the angle oar and a bottom-mounted support.
Figure 16:
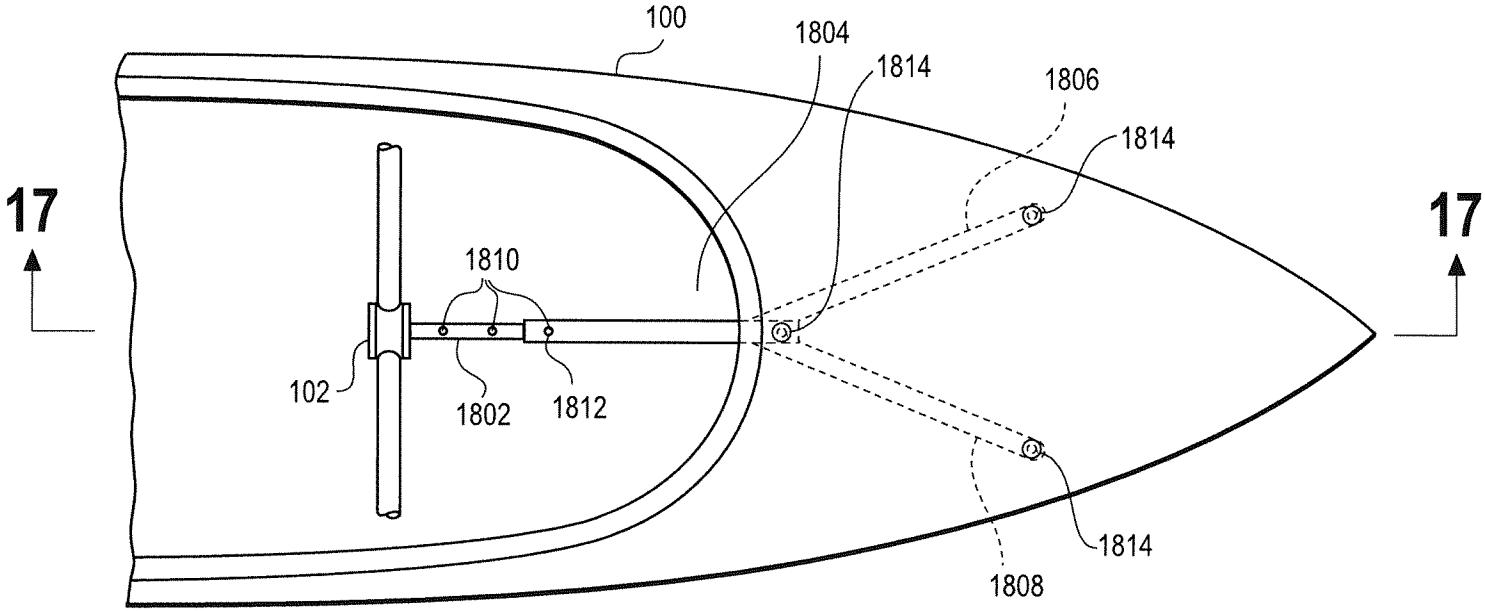
FIG. 16 is a top view of the kayak with the angle oar and a top-mounted support.

FIG. 1 depicts a kayak 100 with an angle oar 102 in accordance with one embodiment installed. The view is looking towards the bow of the kayak with the longitudinal axis being normal to the plane of the page. The angle oar 102 includes a central support with a clevis 104. A left paddle arm is comprised of a left blade 106, a left outer tube 108 and a left inner tube 110. A right paddle arm is comprised of a right blade 112, a right outer tube 114, and a right inner tube 116. A support post 118 (also referred to as a rotation shaft) is shown. The support post 118 is anchored to the kayak. Two examples of support post anchorage, a bottom-mounted anchorage 1302 (as shown in FIG. 11) and a top-mounted anchorage 1800 (as shown in FIG. 16), are described below. The clevis 104 is coupled to the top of the support post 118. The left blade 106 is coupled to the left end of the left outer tube 108. The right end of the left outer tube 108 is coupled to the left end of the left inner tube 110 with an adjustable connection. The right end of the left inner tube 110 is coupled to the clevis 104 with a connection that allows for rotation about an axis concurrent with the central hub and approximately normal to the longitudinal kayak axis. The right blade 112 is coupled to the right end of the right outer tube 114. The left end of the right outer tube 114 is attached to the right end of the right inner tube 116 with an adjustable connection as described below. The left end of the right inner tube 116 is coupled to the clevis 104 with a connection that allows for rotation about an axis concurrent with the central hub and approximately normal (e.g., normal or angled slightly forward of normal, e.g., seven degrees forward of normal) to the longitudinal kayak axis (substantially normal to a plane of travel of a kayak, e.g., a plane of a surface of water on which the kayak is traveling). The shape of the left blade face 120 and right blade face 122 are such that the faces come to a point that aligns with the left outer tube longitudinal axis and right outer tube longitudinal axis, respectively. An upper half and a lower half of the left blade face 120 and an upper half and a lower half of the right blade face 122 have equal planar areas. The upper half and lower half of the right blade face 122 are juxtaposed on opposite sides of the right outer tube 114 and are coplanar with one another. The upper half and lower half of the left blade face 120 are juxtaposed on opposite sides of the left outer tube 108 and are coplanar with one another.

Figure 2:
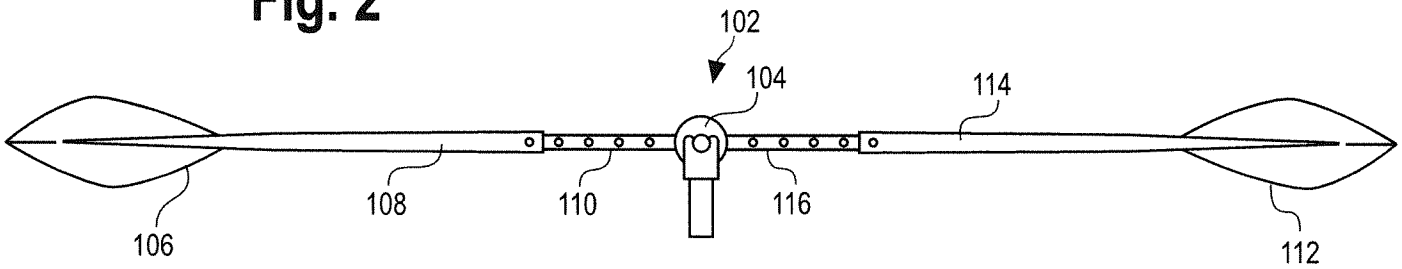
FIG. 2 is a simplified rear view of the angle oar according to some embodiments.

FIG. 2 depicts the angle oar 102 adjusted for maximum paddle arm length on each paddle arm and the outer tubes 108, 114 aligned on a straight axis. The length of each paddle arm is independently adjustable as described below.

Figure 3:
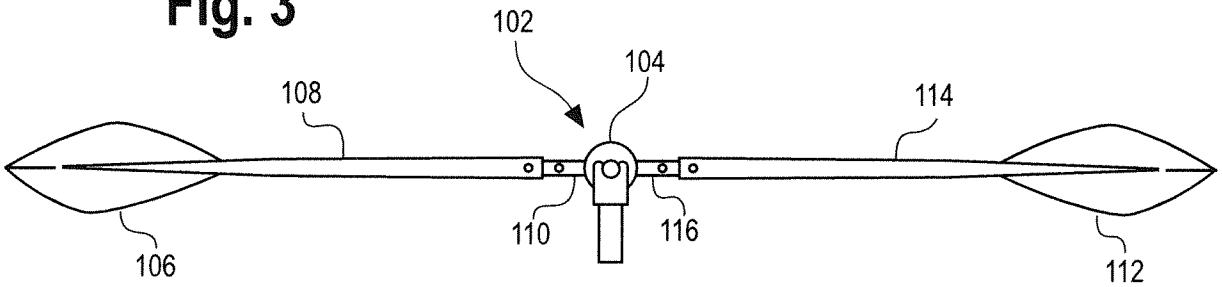
FIG. 3 is a simplified rear view of the angle oar according to some embodiments.

FIG. 3 depicts the angle oar 102 adjusted for minimum paddle arm length on each side and the paddle arms aligned on a straight axis.

Figure 4:
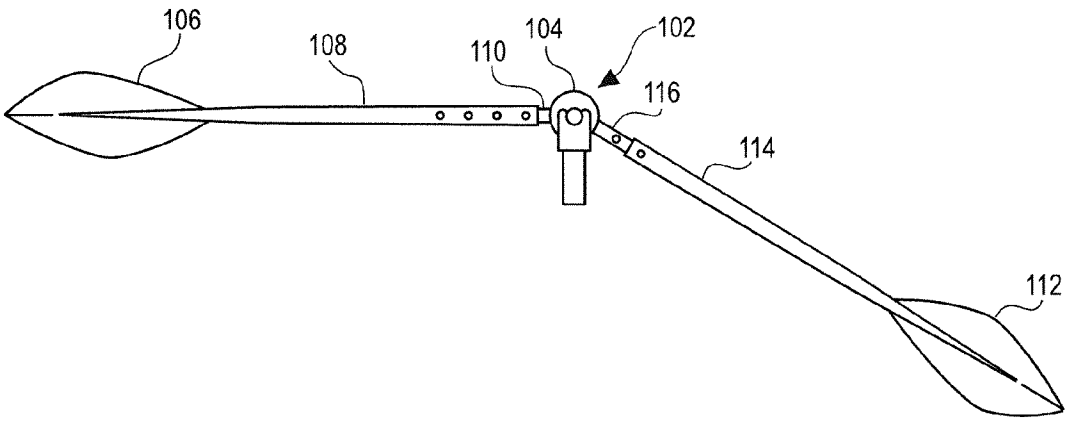
FIG. 4 is a simplified rear view of the angle oar according to some embodiments.

FIG. 4 depicts the angle oar 102 adjusted for minimum paddle arm length on each paddle arm and the left paddle arm is rotated clockwise about the central hub so as to create an angle between the right paddle arm and the left paddle arm.

Figure 5:
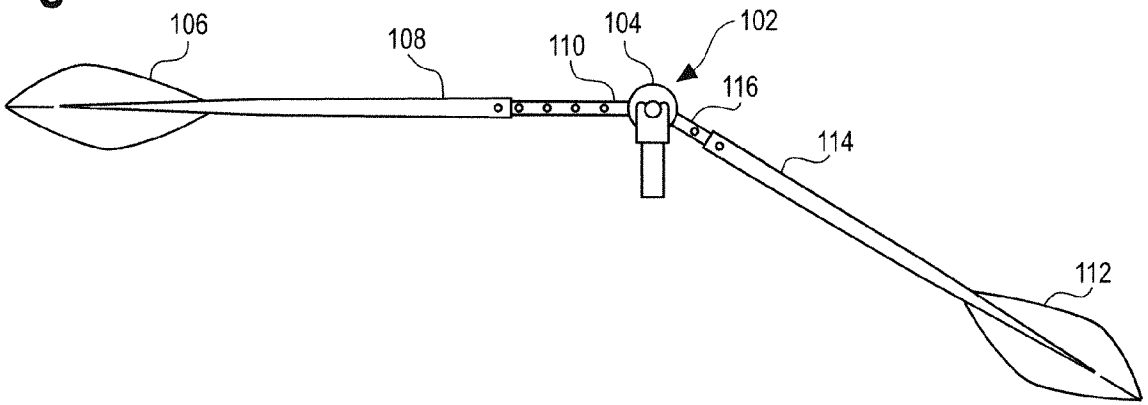
FIG. 5 is a simplified rear view of the angle oar according to some embodiments.

FIG. 5 depicts the angle oar 102 adjusted for maximum paddle arm length on the left hand side and the right paddle arm rotated clockwise. The right side paddle arm is adjusted for minimum paddle arm length.

Figure 6:
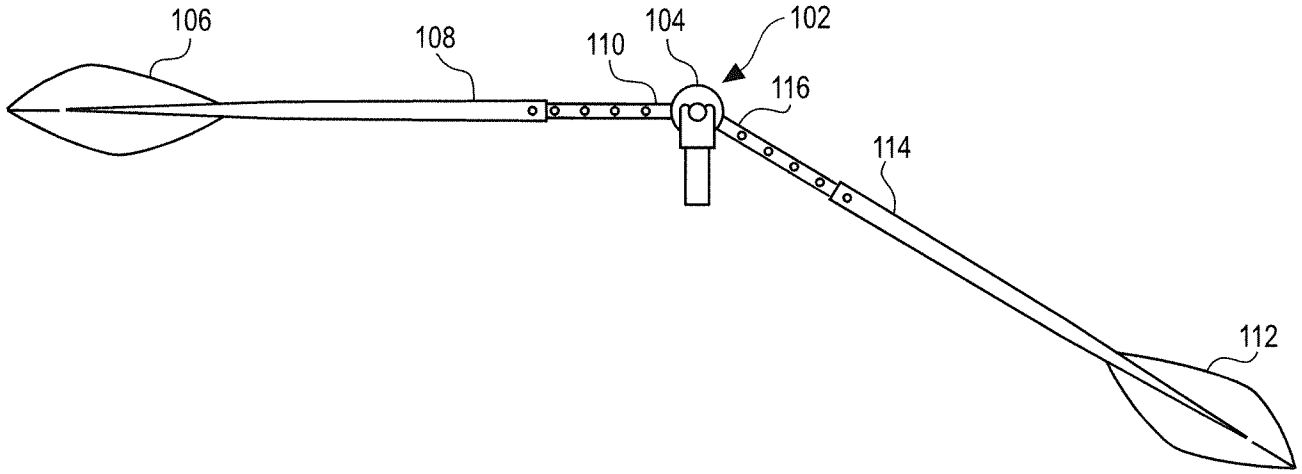
FIG. 6 is a simplified rear view of the angle oar according to some embodiments.

FIG. 6 depicts the angle oar 102 adjusted for maximum paddle arm length on the left side and the right paddle arm rotated clockwise. The right paddle arm is adjusted for maximum paddle arm length.

Figure 7:
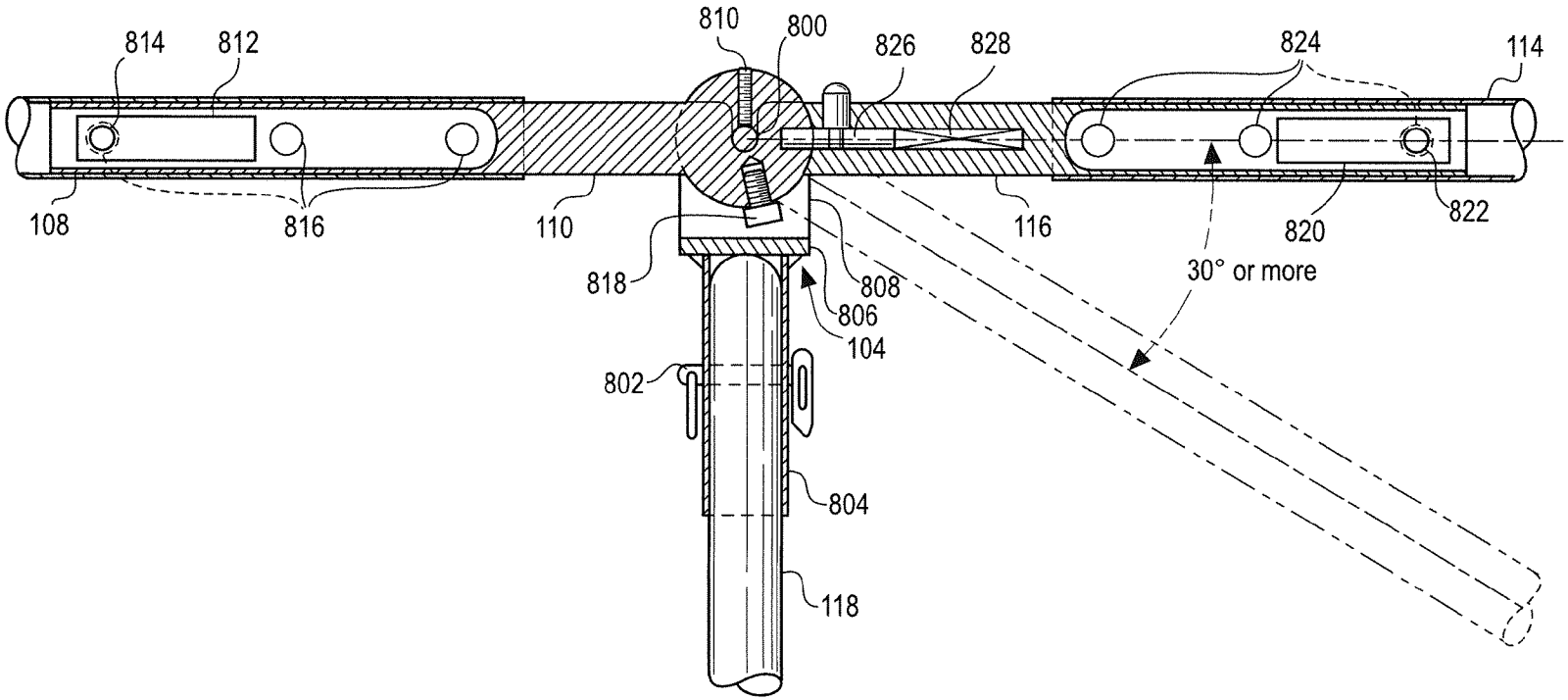
FIG. 7 is a side cross-sectional view of the central portion of the angle oar.

FIG. 7 depicts a vertical section through the central hub of the angle oar 102 in accordance with one embodiment. The center support includes the support post 118, the clevis 104, a pivot pin 800 and a clevis lock pin 802. Shown are a clevis base tube 804 (also referred to as a sleeve), a clevis base plate 806 and a clevis front plate 808. In one embodiment, the pivot pin 800 is held in place by a set screw 810. The portion of the left paddle arm shown includes the left outer tube 108 and the left inner tube 110. A left adjusting spring 812 with a left adjusting button 814 is shown. A plurality of left adjusting holes 816 are shown. A cam head adjustment bolt 818 (also referred to as a cam bolt) is shown coupled to the right end of the left inner tube 110. The portion of the right paddle arm shown includes the right outer tube 114 and the right inner tube 116. A right adjusting spring 820 with a right adjusting button 822 is shown. A plurality of right adjusting holes 824 are shown. A sliding bolt lock 826 and a sliding bolt lock spring 828 are located on the right inner tube 116 adjacent to the clevis 104.

Figure 8:
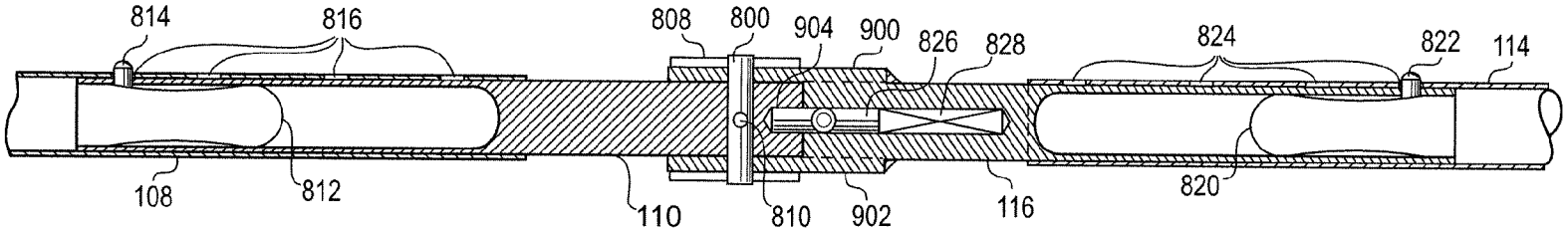
FIG. 8 is a top cross-sectional view of the central portion of the angle oar.

Referring next to FIG. 8, a horizontal section through the central support of the angle oar 102 is shown in accordance with one embodiment of the invention. The central support portion including the clevis 104 and pivot pin 800 is shown. In one embodiment, the pivot pin 800 is held in place by a set screw 810. The portion of the left paddle arm shown includes the left outer tube 108 and the left inner tube 110. A left adjusting spring 812 with a left adjusting button 814 is shown. A plurality of left adjusting holes 816 are shown. The portion of the right paddle arm shown includes the right outer tube 114 and the right inner tube 116. A right adjusting spring 820 with a right adjusting button 822 is shown. A plurality of right adjusting holes 824 are shown.

The bottom tube portion of the clevis 104 fits over and is supported by the cylindrical support post 118. In one embodiment, the clevis lock pin 802 secures the clevis 104 to the support post 118. The top of the clevis 104 is shaped to support the pivot pin 800. In one embodiment, the pivot pin 800 is secured to the left inner tube 110 with a set screw 810. The right end of the left inner tube 110 has a cylindrical shape with a central hole. The pivot pin 800 goes through the central hole, providing support and rotation for the left and right paddle arms. The set screw 810 bears against the pivot pin 800 so that the left inner tube 110 and pivot pin 800 move together, independently of the clevis 104 and right inner tube 116. The sliding bolt lock 826 is located in a recess in the left end of the right inner tube 116. The left end of the right inner tube 116 includes a front outer plate 900 and a rear outer plate 902, each coupled to an opposite side of the left end of the right inner tube 116. The outer plates 900, 902 are located on either side of the cylindrical portion of the left inner tube 110 and are supported by and may rotate about the pivot pin 800. The left and right adjusting springs 812, 820 are located in the left and right outer tubes 108, 114. The left and right adjusting buttons 814, 822 are coupled to the left and right adjusting springs 812, 820. The left and right outer tubes 108, 114 have a plurality of left and right adjusting holes 816, 824 which align with the left or right adjusting button 814, 822.

In one embodiment of the invention, the clevis base tube 804 receives and is supported by the support post 118, the clevis base tube further being rotatable about a longitudinal rotation shaft axis of the support port 118 when the clevis lock pin 802 is not used. The top portion of the clevis 104 includes two vertical sides located outside of the left and right inner tubes 110, 116. The clevis sides, along with the pivot pin 800, provide support for the paddle arms and allow for rotation of the paddle arms about the pivot pin axis. In one configuration, the sliding bolt lock 826 is moved to its leftmost position. A portion of the sliding bolt lock 826 is received by a sliding bolt lock hole 904 in the cylindrical portion of the left inner tube 110. The sliding bolt lock hole 904 is located so that engagement of the lock will align the longitudinal axes of the left and right paddle arms and prevent them from moving relative to one another. The sliding bolt lock spring 828 is sufficiently tensioned to keep the sliding bolt lock 826 in the leftmost position while allowing for a person to slide the sliding bolt lock 826 to the rightmost position when desired. When the sliding bolt lock 826 is moved to its rightmost position, the right paddle arm rotates clockwise until its rotation is stopped by the cam head adjustment bolt 818. Alternately, when the sliding bolt lock 826 is moved to its rightmost position, the left paddle arm may be rotated clockwise towards the right paddle arm, allowing for a shorter paddle arm profile.

In one embodiment, the paddle arms include a button spring mechanism. On the left paddle arm, the left adjusting spring 812 is coupled to the inside of the left inner tube 110. The left adjusting button 814 is coupled to the left adjusting spring 812 so that the left adjusting button 814 extends through one of the left adjusting holes 816, locking the length of the paddle arm. The left adjusting spring 812 holds the left adjusting button 814 in place. To adjust the length of the left paddle, the left adjusting button 814 is depressed until the button top is below the left outer tube 108, allowing the left outer tube 108 to slide relative to the left inner tube 110. The left outer tube 108 slides to the left or right until the left adjusting button 814 aligns with an alternate left adjusting hole and the left adjusting spring 812 causes the left adjusting button 814 to extend through the alternate left adjusting hole. The difference between the previous left adjusting hole and the current left adjusting hole is the change in left paddle arm length. The right paddle arm is adjusted in a similar way.

Figure 9:
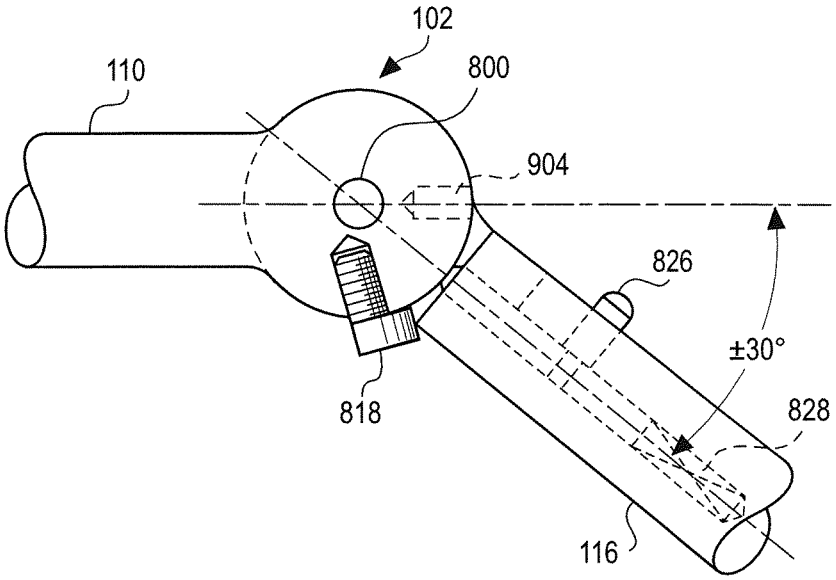
FIG. 9 is a side view of the center hub of the angle oar.
Figure 9A:
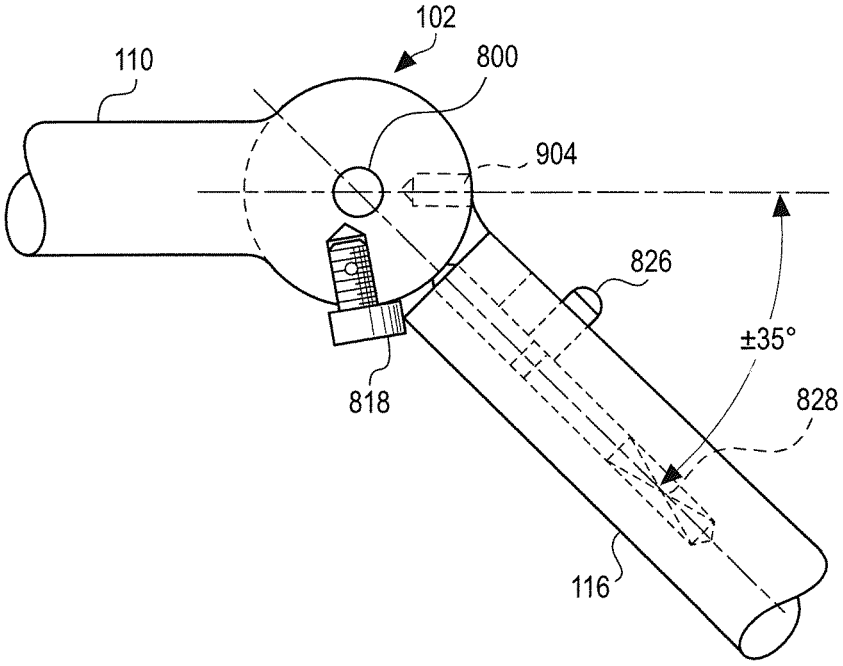
FIG. 9A is a side view of the center hub of the angle oar.
Figure 9B:
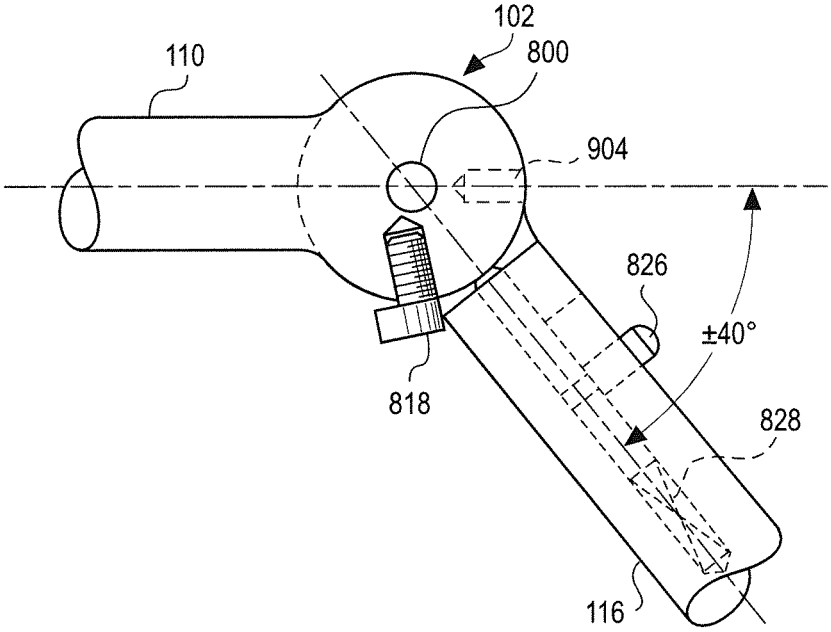
FIG. 9B is a side view of the center hub of the angle oar.
Figure 10:
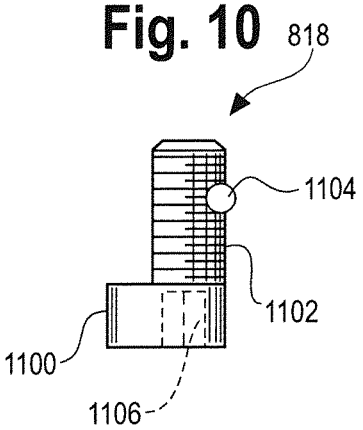
FIG. 10 is a side view of a cam head adjustment bolt.

FIG. 9 depicts a detail of the central portion of the angle oar 102. Shown are the left inner tube 110, the right inner tube 116, the pivot pin 800, the sliding bolt lock 826, the sliding bolt lock hole 904, the sliding bolt lock spring 828 and the cam head adjustment bolt 818. In one embodiment, the cam head adjustment bolt 818 has an offset cam head adjustment bolt head 1100 (as shown in FIG. 10). The sliding bolt lock 826 is shown in the rightmost position, uncoupling the paddle arms and allowing the right paddle arm to be rotated clockwise. The clockwise rotation is stopped when the right inner tube 116 contacts the cam head adjustment bolt head 1100 of the cam head adjustment bolt 818. In one embodiment, the cam head adjustment bolt 818 is adjusted one quarter turn so that the allowed rotation is approximately 30° when the maximum head overhang of the cam head adjustment bolt 818 contacts the right inner tube 116. FIG. 9A shows the cam head adjustment bolt 818 adjusted one half turn so that the allowed rotation angle is increased. FIG. 9B shows the cam head adjustment bolt 818 adjusted so that the allowed rotation angle is maximized to approximately 40°.

Figure 10A:
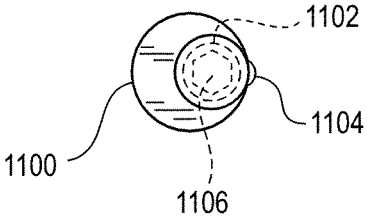
FIG. 10A is a bottom view of the cam head adjustment bolt with an offset head.

Referring next to FIG. 10, a detail of one embodiment of the cam head adjustment bolt 818 is shown. The cam head adjustment bolt head 1100 is shown offset from a cam head adjustment bolt shaft 1102. In one embodiment, the cam head adjustment bolt head 1100 is offset from the cam head adjustment bolt shaft 1102 so that the cam head adjustment bolt head 1100 aligns with the cam head adjustment bolt shaft 1102 at a single point, as shown in FIG. 10A. A thread locking bead 1104 is shown on the cam head adjustment bolt shaft 1102. In this embodiment, the cam head adjustment bolt 818 diameter is 5/16", the cam head adjustment bolt head 1100 diameter is 5/8", and the cam head adjustment bolt head 1100 thickness is 3/8". In one embodiment, the cam head adjustment bolt head 1100 has a hexagonal socket drive 1106.

Referring next to FIG. 11, one embodiment of angle oar anchorage is shown. A top view shows the kayak 100, a kayak seat 1300, the angle oar 102 and a bottom-mounted anchorage 1302. The bottom-mounted anchorage 1302 contains a plurality of support post cavities 1304. The support post 118 fits in the bottom-mounted anchorage 1302, which is coupled to the kayak floor (also referred to as the kayak deck) by plastic welding or other suitable method. The support post 118 may be placed in any of the support post cavities 1304 (also referred to as step holes).

Figure 12:
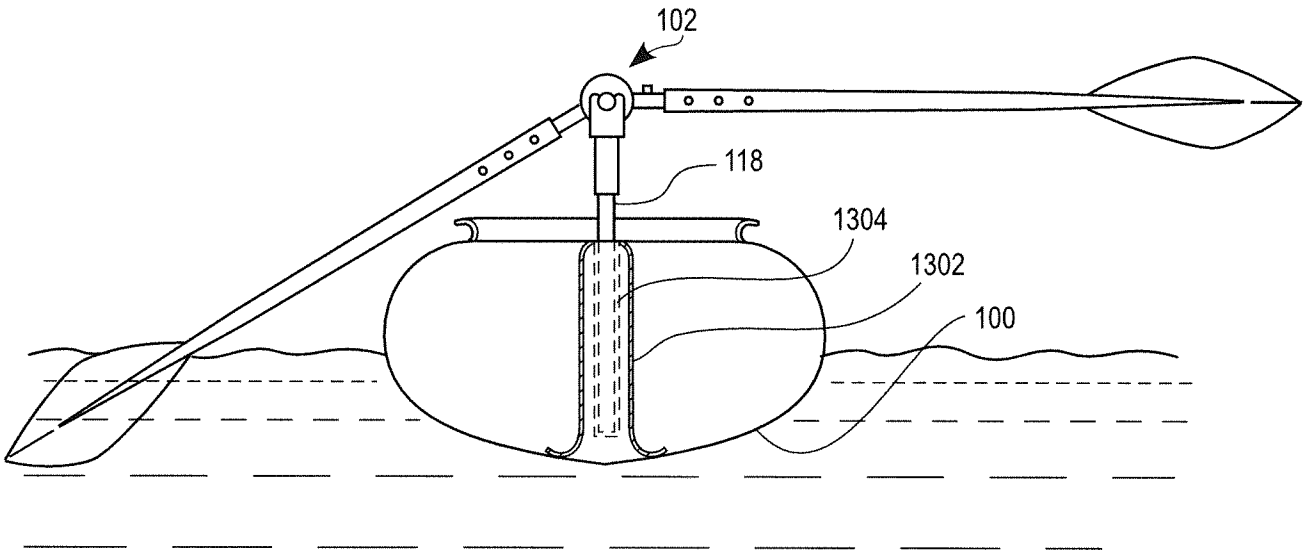
FIG. 12 is a rear cross-sectional view of the kayak with the angle oar and the bottom-mounted support.

FIG. 12 depicts a section through the kayak 100 looking towards the kayak bow. The kayak 100, angle oar 102, support post 118, bottom-mounted anchorage 1302 and support post cavity 1304 are shown.

Figure 13:
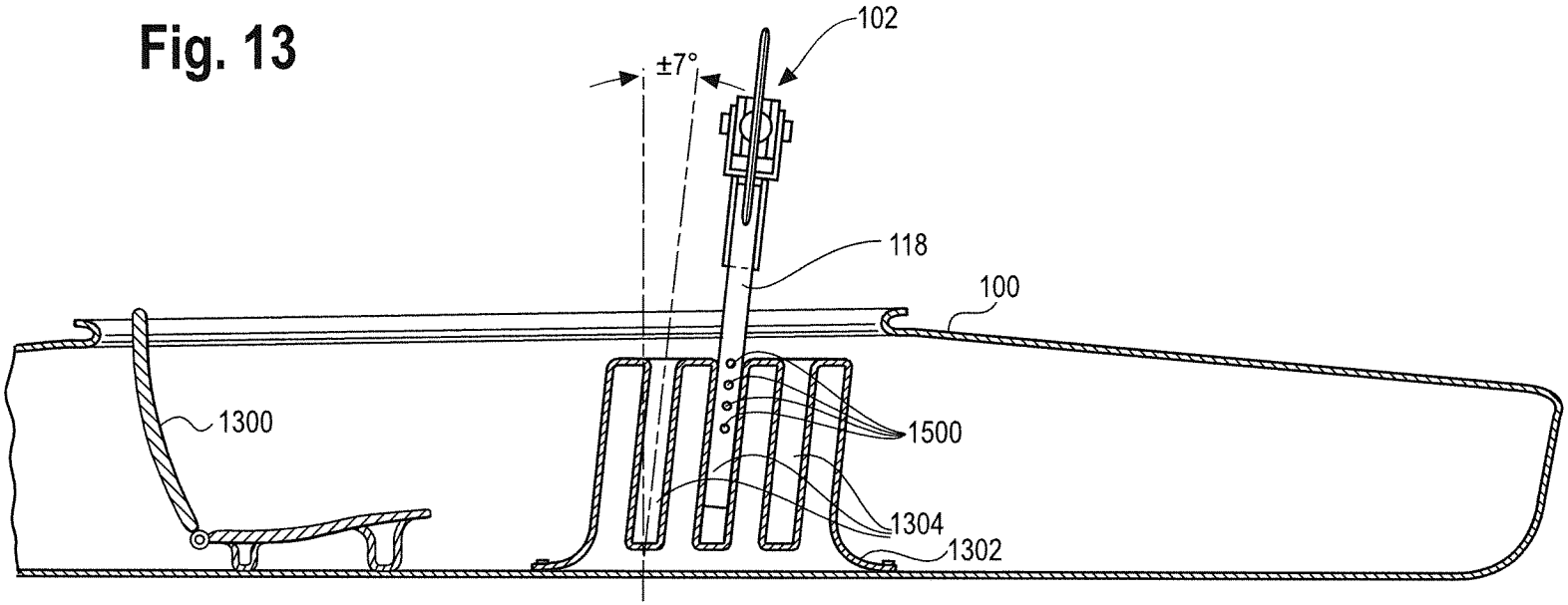
FIG. 13 is a side cross-sectional view of the kayak with the angle oar and the bottom-mounted support.

FIG. 13 shows a longitudinal section through the center of the kayak 100. Shown are the kayak 100, the kayak seat 1300, the angle oar 102, the support post 118, the bottom-mounted anchorage 1302 and a plurality of support post cavities 1304. A plurality of support post adjustment holes 1500 are shown. The bottom-mounted anchorage 1302 is coupled to the kayak floor. The joint between the bottom-mounted anchorage 1302 and the kayak floor is sealed to prevent water from infiltrating the joint. The support post cavities 1304 are angled approximately 7° towards the kayak bow. The support system angle automatically angles the kayak paddle blades 106, 112 to provide some drag, advantageously keeping the blade 106 or 112 in the water during the stroke.

Figure 14:
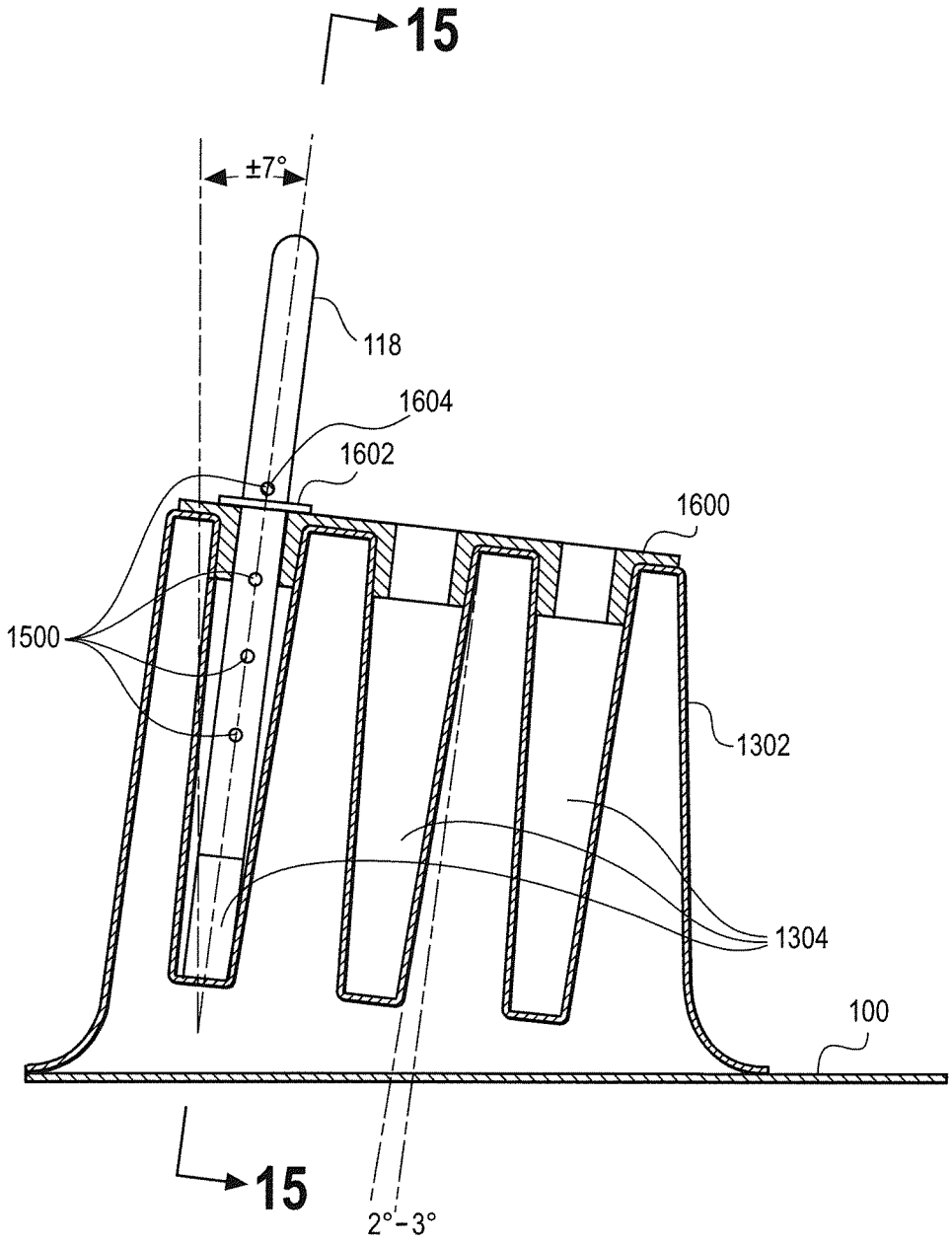
FIG. 14 is a side cross-sectional detail of the bottom-mounted support.

Referring next to FIG. 14, a detail of the longitudinal section of the bottom-mounted support 1302 is shown. Shown is the kayak 100, the bottom-mounted anchorage 1302, a plurality of support post cavities 1304, the support post 118, a bushing 1600, a plurality of support post adjustment holes 1500, a washer 1602 and an adjustment pin 1604. The support post cavities 1304 are of tapered cone shape, with the narrower end at the bottom. In one embodiment of the invention, the cone is tapered to accommodate manufacturing requirements, with an approximate required angle of 2°-3°. The bushing 1600 sits on top of the support post cavities 1304. Holes are located in the bushing 1600 to align the support post 118 in the support post cavity 1304 and prevent lateral movement of the support post 118. In one embodiment of the invention, the support post 118 is supported by the bottom of the support post cavity 1304. In another embodiment, the support post 118 and consequently the angle oar 102 may be raised by raising one of the support post adjustment holes 1500 above the top of the bottom-mounted anchorage 1302 and sliding the adjustment pin 1604 through the support post adjustment holes 1500 to secure the post. The washer 1602 is placed between the bushing 1600 and the adjustment pin 1604 to provide additional bearing support for the adjustment pin 1604.

Figure 15:
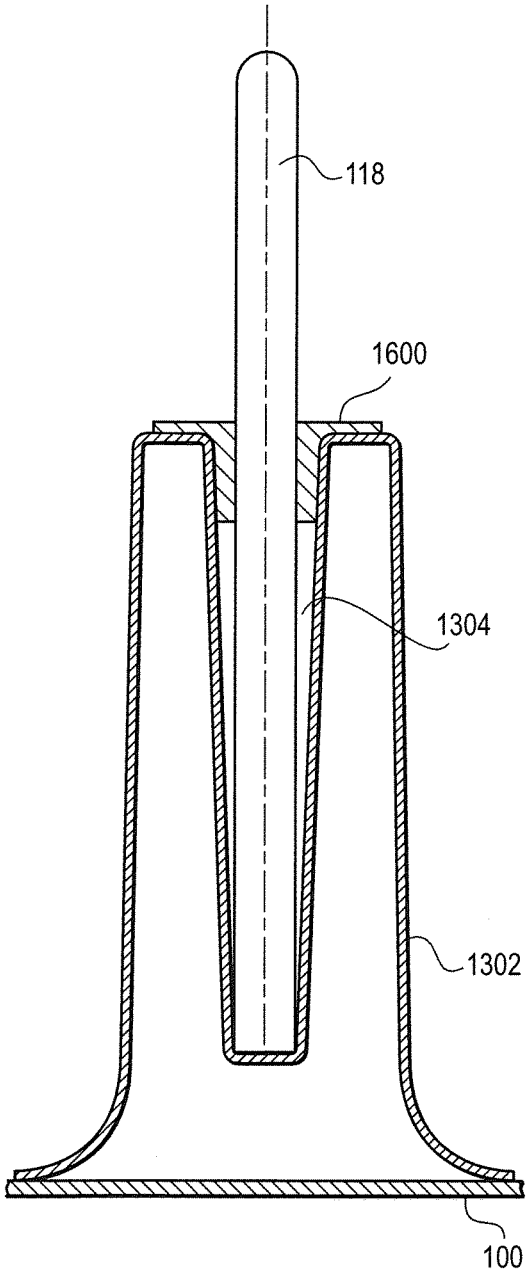
FIG. 15 is a rear cross-sectional view of the bottom-mounted support.

Referring next to FIG. 15, a detail of a transverse section through the bottom-mounted anchorage 1302 is shown. The kayak 100, bottom-mounted anchorage 1302, support post 118 and bushing 1600 are shown. In this embodiment, the support post 118 is shown supported by the bottom of the support post cavity 1304.

Referring next to FIG. 16, another embodiment of angle oar anchorage is shown. The top-mounted anchorage 1800 includes an adjustable tube 1802, a main support tube 1804, a left support arm 1806 and a right support arm 1808. Also shown is the kayak 100 and a portion of the angle oar 102. A plurality of adjustable tube holes 1810 and an adjusting button 1812 are shown. The main support tube 1804 and the support arms 1806, 1808 are secured to the top of the kayak 100. In one embodiment, a plurality of bolts 1814 connect the main support tube 1804 and the support arms to the top of the kayak 100. The angle of the support arms 1806, 1808 provides rotational stability to the top-mounted anchorage 1800.

Figure 17:
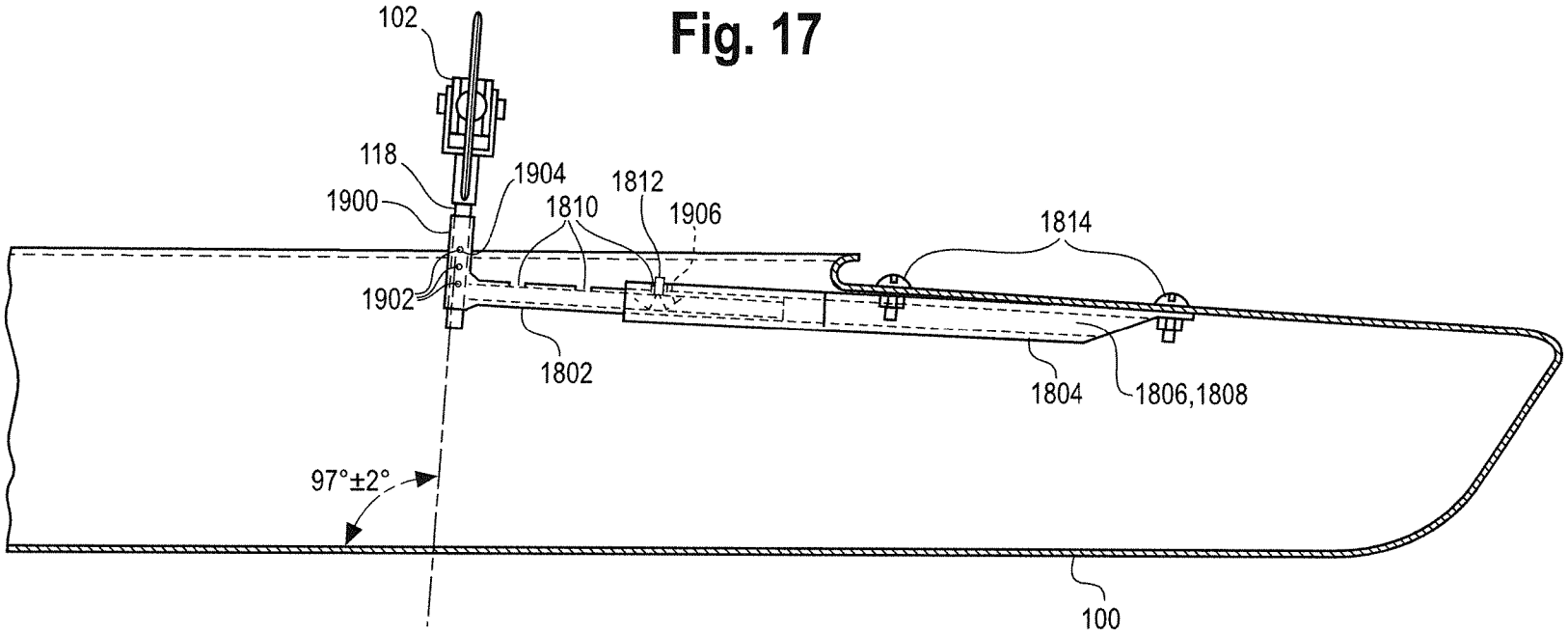
FIG. 17 is a side cross-sectional view of the kayak with the angle oar and top-mounted support.

FIG. 17 depicts a longitudinal cross-section through the top-mounted anchorage 1800. Shown is the kayak 100, the angle oar 102, the support post 118, a vertical support member 1900, the adjustable tube 1802, the main support tube 1804, the left support arm 1806 and the right support arm 1808. A plurality of vertical adjustment holes 1902 are shown on the vertical support member 1900. The support post 118 is adjusted vertically by means of the vertical adjustment holes 1902 and a support pin 1904. The vertical support member 1900 is coupled to the adjustable tube 1802. In one embodiment, the angle between the vertical support tube member 1900 and the kayak floor is approximately 3°. The adjusting button 1812 is coupled to the adjusting spring so that the adjusting button 1812 extends through one of the adjustable tube holes 1810, locking the angle oar 102 in place horizontally. An adjusting spring 1906 holds the adjusting button 1812 in place. To adjust the horizontal position of the angle oar 102, the adjusting button 1812 is depressed until the adjusting button 1812 top is below the main support tube 1804, allowing the adjustable tube 1802 to slide relative to the main support tube 1804. The adjustable tube 1802 slides fore or aft until the adjusting button 1812 aligns with an alternate adjusting hole and the adjusting spring 1906 causes the adjusting button 1812 to extend through the alternate adjusting hole. The difference between the previous adjusting hole and the current adjusting hole is the change in angle oar 102 location. The plurality of bolts 1814 connecting the top-mounted anchorage 1800 to the kayak top are shown. A template may be supplied for locating the bolt holes in the top of the kayak.

Figure 18:
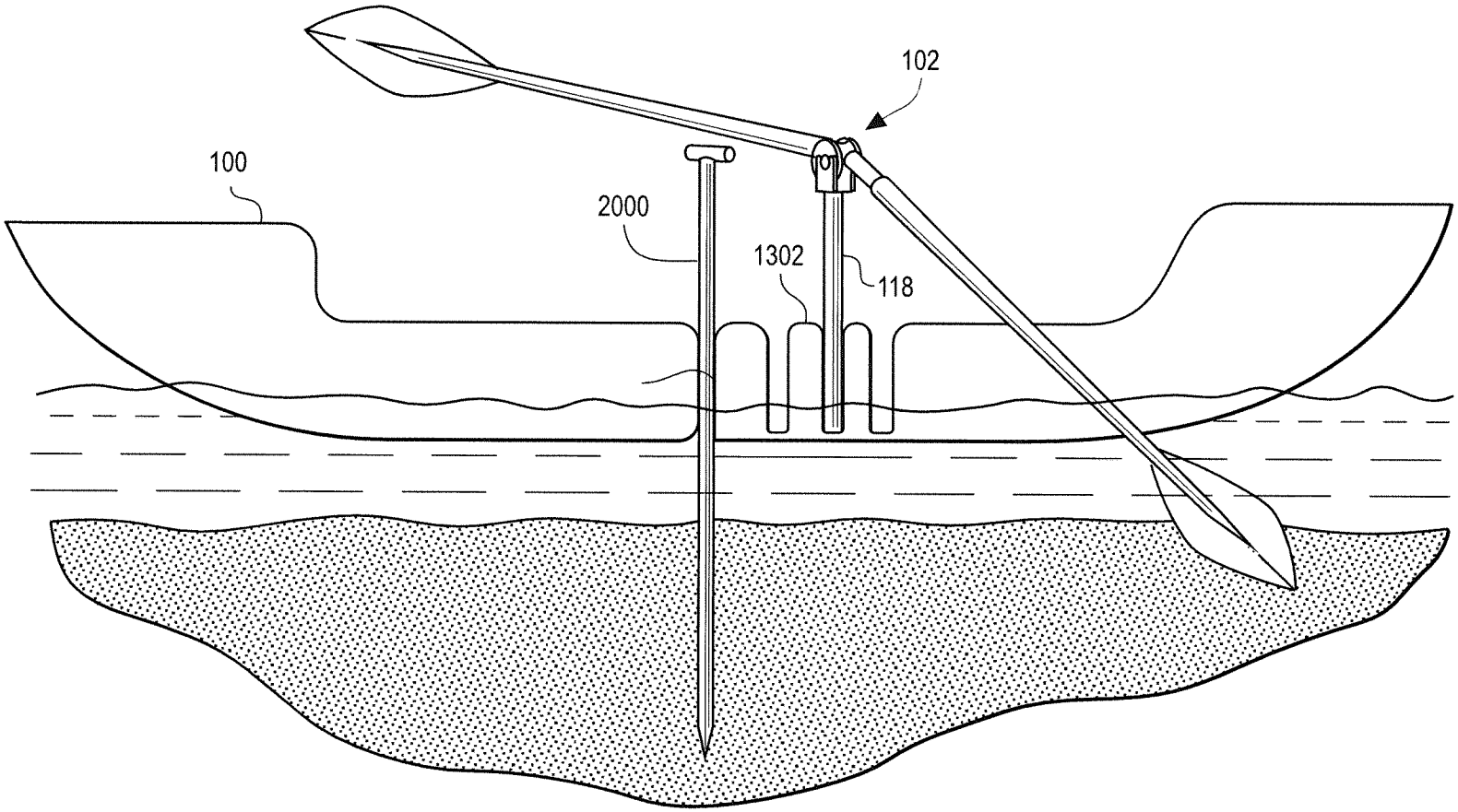
FIG. 18 is a simplified side view of the kayak with the angle oar, the bottom-mounted support, and a stabilizing rod

Referring next to FIG. 18, one embodiment of the invention includes a stabilizing rod 2000 for a sit-on kayak. Shown is the kayak 100, stabilizing rod 2000, angle oar 102, support post 118 and bottom-mounted anchorage 1302. In one embodiment, the stabilizing rod 2000 is made of fiberglass or aluminum. The stabilizing rod 2000 has a tee handle. One or more through tubes 2002 are provided, allowing the stabilizing rod 2000 to pass through the kayak 100 without allowing water to enter the kayak 100.

Figure 19:
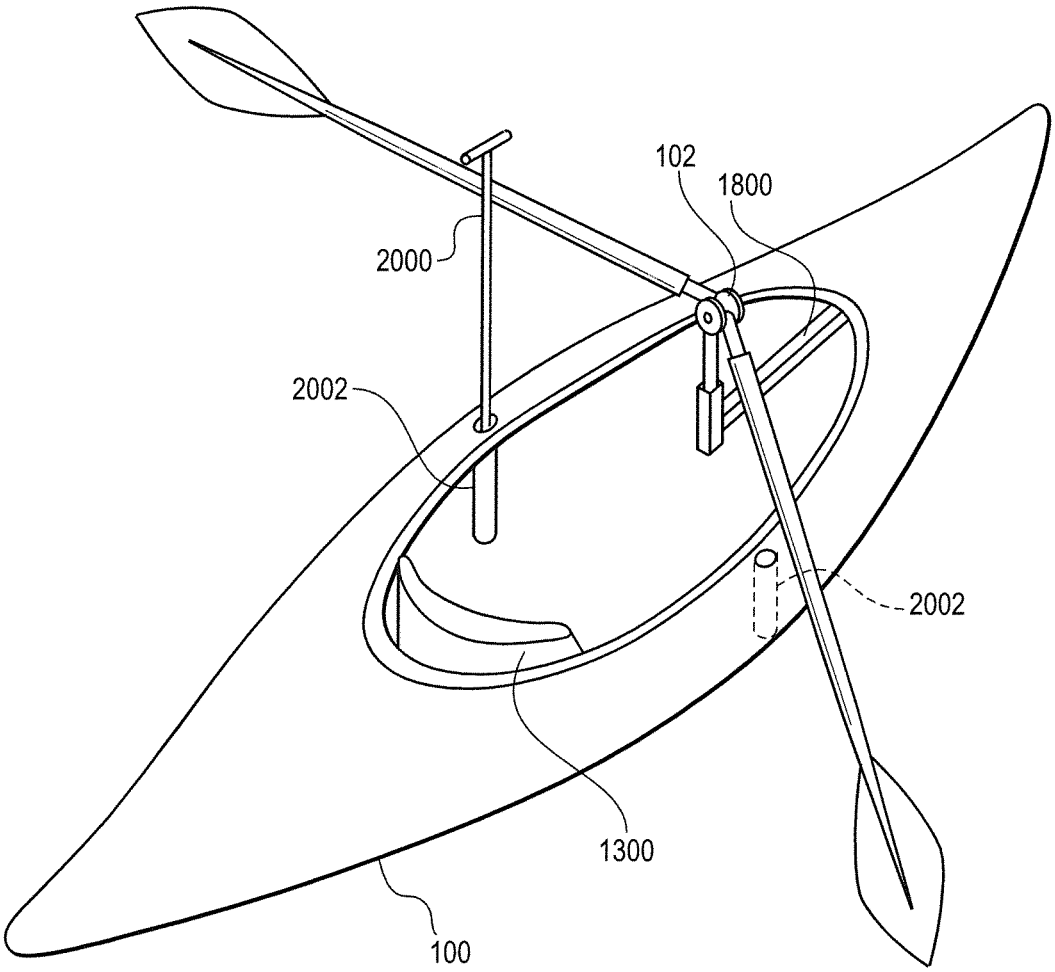
FIG. 19 is a perspective view of the kayak with the angle oar, top-mounted support and the stabilizing rod.

FIG. 19 depicts an isometric of the sit-on kayak 100 with the angle oar 102 and the stabilizing rod 2000. Also shown are the kayak seat 1300, the support post 118, the top-mounted anchorage 1800 and the plurality of through tubes 2002.

While the invention herein disclosed has been described by means of specific embodiments, examples and applications thereof, numerous modifications and variations could be made thereto by those skilled in the art without departing from the scope of the invention set forth in the claims.

What is claimed is:

1. A vehicle propulsion system comprising:

a clevis including a base portion configured to couple to a substantially vertical vehicle support post such that the base portion rotates about a vehicle support post longitudinal axis, and a top portion configured to support a pivot pin along a generally horizontal rotation axis;

a generally cylindrical pivot pin coupled to the clevis and rotatable about the generally horizontal rotation axis;

a left tube including a central hole in a left tube end proximate to the clevis, wherein the pivot pin passes through the central hole, whereby the left tube is coupled to the pivot pin and the rotates about the pivot pin, a longitudinal axis of the left tube located in a plane generally perpendicular to the generally horizontal rotation axis, a left tube end distal to the clevis configured for coupling to a blade; and a right tube including a front outer plate and a rear outer plate extending from an end of the right tube proximate to the clevis, the front outer plate and the rear outer plate each including a hole, wherein the end of the left tube proximate to the clevis is interposed between the front outer plate and the rear outer plate, aligning the front outer plate hole, the rear outer plate hole, and the central hole, wherein the pivot pin passes through the front outer plate hole and the rear outer plate hole, wherein a longitudinal axis of the right tube is located in the plane generally perpendicular to the generally horizontal rotation axis, a right tube end distal to the clevis further configured for coupling to a blade, the end of the right tube proximate to the clevis further comprising a lock configured to removably engage with the left tube, whereby a position of the right tube relative to the left tube is locked when the lock is engaged with the left tube.

2. The vehicle propulsion system according to claim 1, further comprising at least one blade coupled to at least one of the right tube and the left tube.

3. The vehicle propulsion system according to claim 1, the left tube and the pivot pin further configured to receive a set screw coupling the left tube to the pivot pin and preventing rotation of the left tube with respect to the pivot pin.

4. The vehicle propulsion system according to claim 1, wherein the lock includes a sliding bolt lock coupled to the end of the right tube proximate to the clevis, the sliding bolt lock including a spring configured to engage the left tube and lock the left tube in position with respect to the right tube.

5. The vehicle propulsion system according to claim 4, the left tube end proximate to the clevis further comprising a lock hole configured to engage with the sliding bolt lock.

6. The vehicle propulsion system according to claim 4, wherein the sliding bolt lock is configured to allow a user to slide the sliding bolt lock to an unlocked position.

7. The vehicle propulsion system according to claim 6, wherein a spring constant of the spring allows the user to compress the spring by sliding the sliding bolt lock, whereby the sliding bolt lock is slid to the unlocked position.

8. The vehicle propulsion system according to claim 1, wherein the left tube is configured such that the longitudinal axis of the left tube is aligned with the longitudinal axis of the right tube when the lock is engaged with the left tube.

9. The vehicle propulsion system according to claim 1, wherein left tube is configured such that the longitudinal axis of the left tube is at an angle to the longitudinal axis of the right tube when the lock is engaged with the left tube.

10. The vehicle propulsion system according to claim 9, wherein the angle is in the range of 140-150 degrees.

11. The vehicle propulsion system according to claim 1, further comprising at least one of the left tube and the right tube configured to adjustably couple to at least one blade such that a length of the at least one blade is adjustable.

12. The vehicle propulsion system of claim 11, the at least one of the left tube and the right tube further including an internal adjusting spring configured to press an adjusting button through at least one blade adjusting hole.

13. A method for coupling a vehicle propulsion system to a vehicle, comprising the steps of:

coupling a clevis to a substantially vertical vehicle support post, the clevis including a base portion configured to couple to the vehicle support post such that the base portion rotates about a vehicle support post longitudinal axis;

aligning a central hole in a first end of a left tube with a front outer plate hole of a front outer plate of a right tube, and with a back outer plate hole of a front outer plate of the right tube the front outer plate and the back outer plate are coupled to a first end of the right tube, wherein the first end of the left tube is interposed between the front outer plate and the rear outer plate;

rotationally coupling the right tube and left tube by passing a cylindrical pivot pin through the central hole, the back outer plate hole, and the front outer plate hole; and coupling the pivot pin to a top portion of the clevis, wherein the pivot pin is rotatable and supported in a generally horizontal rotation axis.

14. The method of coupling the vehicle propulsion system to the vehicle according to claim 13, further comprising the step of:

locking the left tube in a first position relative to the right tube.

15. The method of coupling the vehicle propulsion system to the vehicle according to claim 14, the right tube further including the sliding bolt lock including a spring configured to engage with the left tube and lock the left tube in the first position.

16. The method of coupling the vehicle propulsion system to the vehicle according to claim 14, further comprising the steps of:

unlocking the left tube from the right tube;

rotating the left tube to a second position relative to the right tube; and relocking the left tube in the second position.

17. The method of coupling the vehicle propulsion system to the vehicle according to claim 13, further comprising the steps of:

coupling at least one blade to at least one of the right tube and the left tube.

* * * * *

UNITED STATES PATENT AND TRADEMARK OFFICE

CERTIFICATE OF CORRECTION

PATENT NO. : 8,986,060 B2
APPLICATION NO. : 13/839452
DATED : March 24, 2015
INVENTOR(S) : Van Gompel It is certified that error appears in the above-identified patent and that said Letters Patent is hereby corrected as shown below:

On the title page, item 56
Page 1, column 2, OTHER PUBLICATIONS, line 3, delete "Kendalville," and insert --Kendallville--.

Signed and Sealed this
Tenth Day of November, 2015

Michelle K. Lee

Michelle K. Lee
*Director of the United States Patent and Trademark Office*